US005928124A

United States Patent [19]

Gherardi et al.

[11] Patent Number: 5,928,124

[45] Date of Patent: Jul. 27, 1999

[54] METHOD AND APPARATUS FOR THE CONTINUOUS FEED OF A STRIP OF MATERIAL TO A MACHINE

[75] Inventors: Gian Luigi Gherardi; Fiorenzo Draghetti, both of Medicina, Italy

[73] Assignee: G.D. S.P.A., Bologna, Italy

[21] Appl. No.: 08/815,611

[22] Filed: Mar. 12, 1997

[30] Foreign Application Priority Data

Mar. 12, 1996 [IT] Italy ..... BO96A0127

[51] Int. Cl.[6] ..... B31B 1/36; B65H 20/00

[52] U.S. Cl. ..... 493/459; 493/39; 493/408; 493/460; 493/465; 226/95; 226/118.1; 162/197; 162/270

[58] Field of Search ..... 493/39, 459, 460, 493/461, 465, 466, 408, 395; 131/365; 162/197, 270, 271; 226/95, 118.1

[56] References Cited

U.S. PATENT DOCUMENTS

| | | | |
|---|---|---|---|
| 3,076,492 | 2/1963 | Monks | 72/160 |
| 3,291,136 | 12/1966 | Boyer | 493/39 |
| 3,291,410 | 12/1966 | Berryman | 226/95 |
| 3,962,957 | 6/1976 | Hinzmann | 162/271 |
| 3,971,696 | 7/1976 | Manfredi | 493/459 |
| 3,996,842 | 12/1976 | Ehlich et al. | 162/271 |
| 4,013,284 | 3/1977 | Demetre | 271/183 |
| 4,103,596 | 8/1978 | Molins | 493/39 |
| 4,684,359 | 8/1987 | Herrington | 493/461 |
| 4,724,429 | 2/1988 | Millen et al. | 493/39 |
| 4,952,281 | 8/1990 | Akira | 493/459 |
| 5,190,233 | 3/1993 | Nelson et al. | 226/95 |
| 5,271,541 | 12/1993 | Roux | 226/95 |
| 5,316,539 | 5/1994 | Leemhuis et al. | 493/459 |
| 5,358,163 | 10/1994 | Naka | 226/95 |
| 5,539,511 | 7/1996 | Wenthe, Jr. et al. | 162/270 |

FOREIGN PATENT DOCUMENTS

| | | | |
|---|---|---|---|
| 291952 | 11/1988 | European Pat. Off. | 226/95 |
| 829122 | 1/1952 | Germany | 493/39 |
| 21 00630 | 10/1971 | Germany . | |
| 2100630 | 10/1971 | Germany | 493/39 |
| 24 21 394 | 11/1975 | Germany . | |
| 3730810 | 3/1989 | Germany | 131/365 |
| 2 249 782 | 5/1992 | United Kingdom . | |

*Primary Examiner*—Lee W. Young
*Assistant Examiner*—A. Dexter Tugbang
*Attorney, Agent, or Firm*—Pillsbury Madison & Sutro LLP

[57] ABSTRACT

A strip of material is fed continuously to a machine, along a given path extending through a curling station for the strip, at which the path has a curved segment which forms a loop. The strip inside the curling station is subjected to flexing, by applying suction to the strip along at least part of the loop.

10 Claims, 2 Drawing Sheets

1
2
2a
3
4
5
6
7
8
9
10
11
11a
12
12a
13
14
15
16
17
18
19
20
21
22
23
24
25
26
27
28
29
30
31
32
33
34
35
35a
36
37
M
C
S

METHOD AND APPARATUS FOR THE CONTINUOUS FEED OF A STRIP OF MATERIAL TO A MACHINE

BACKGROUND OF THE INVENTION

The present invention relates to a method for the continuous feed of a strip of material to a machine.

The present invention is particularly useful when fitted on cigarette making machines, especially filter tip application machines, which are specified in the following description, although without limiting the possibilities for application of the invention.

In the known filter tip application machines, filter tips are applied to cigarettes using bands, each of which is wrapped around and over a filter and part of a cigarette in order to form a filter cigarette.

The bands are cut from a strip of paper, normally drawn from a reel and continuously fed to the filter tip application machine by a strip feed unit.

A known technique to reduce the rigidity of the strip of paper and facilitate the winding of each band around a respective filter and cigarette is the use of paper curling devices.

A known curling device described in U.S. Pat. No. 3,962,957 includes a curling blade, positioned so that it makes contact with the strip and designed to flex the strip transversally. Flexing is effected at a curling station, positioned along a strip feed path, upstream of a device for gumming the strip and a unit which cuts the strip into the filter—cigarette bands.

During operation of the above-mentioned curling device, the strip of paper frequently broke, mainly due to the considerable load to which the strip is subjected downstream of the curling station.

In the curling station, the friction created by the blade on the surface of the strip is enough to cause sudden and uncontrollable increases in the tension of the strip as it moves towards the filter tip application machine.

Moreover, the curling blade in the said device is subject to rapid wear and so damages the strip, as well as necessitating frequent stopping of the filter tip application machine to allow substitution of the blade.

SUMMARY OF THE INVENTION

The object of the present invention is to overcome the aforementioned disadvantages by creating a method for the continuous feed of a strip of material.

The present invention relates to a method for the continuous feed of a strip of material to a machine, the method including the strip feed phase along a path which extends through a strip curling station, at which the strip is flexed; the method being characterized in that within the curling station, the path includes a curved segment which forms a loop; the flexing including a phase during which the strip is sucked along at least part of the loop.

The present invention also relates to a unit for the continuous feed of a strip of material to a machine.

According to the present invention, a unit is created for the continuous feed of a strip of material to a machine, the unit including drive means designed to feed the strip along a path which extends through a strip curling station; and flexing means designed to flex the strip, the flexing means being housed in the curling station; the unit being characterized in that, within the curling station, the path includes a curved segment which forms a loop; the flexing means including suction means which apply suction to the strip along at least part of the loop.

BRIEF DESCRIPTION OF THE DRAWINGS

The present invention is described below with reference to the accompanying drawings, which illustrate several embodiments by way of example only, and in which.

DESCRIPTION OF THE PREFERRED EMBODIMENTS

Figure 1:
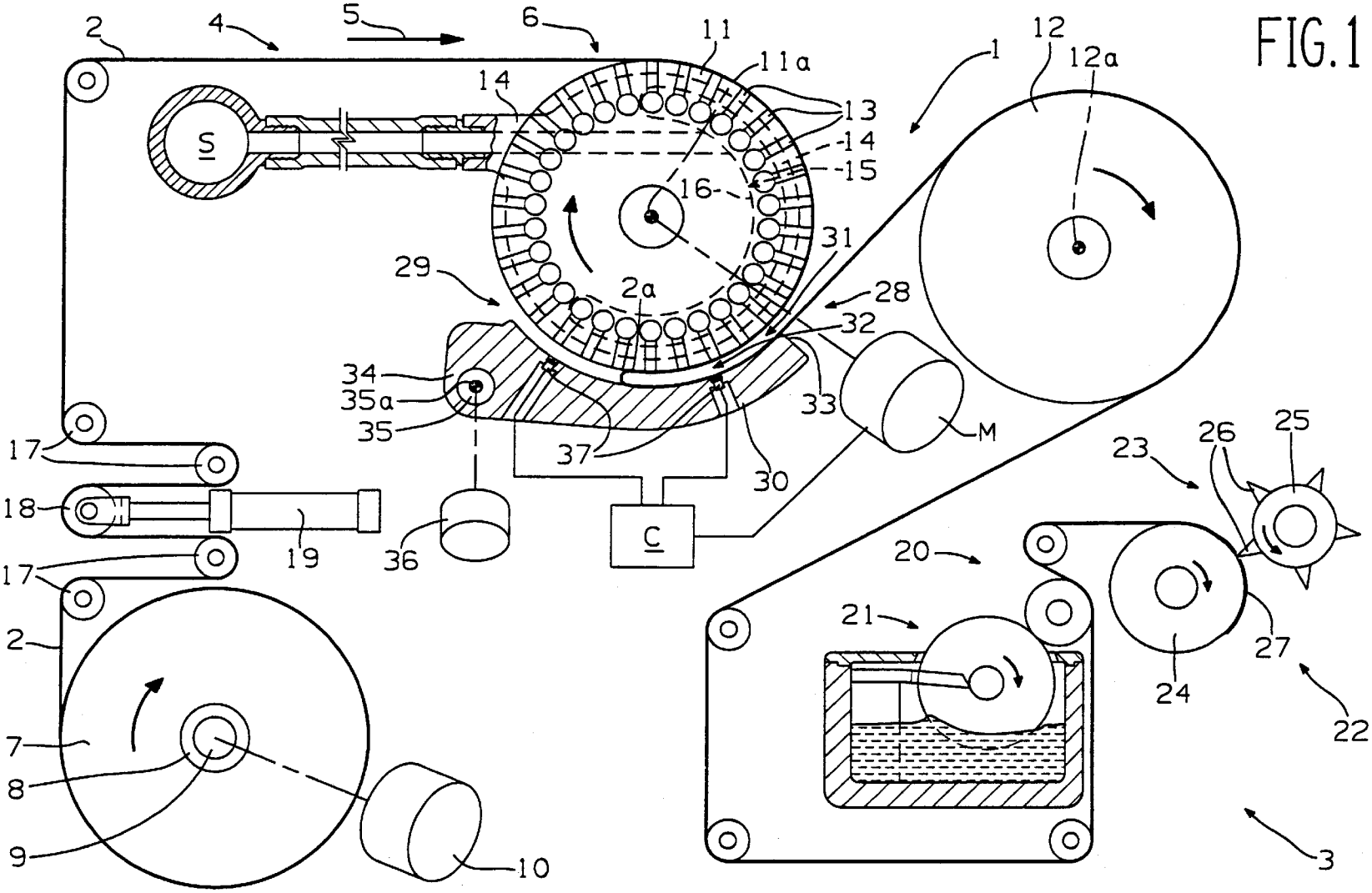
FIG. 1 is a schematic view, partly shown in cross-section and with some parts cut away to better illustrate others, of a preferred embodiment of the feed unit disclosed.

With reference to FIG. 1, the number 1 denotes a unit for the continuous feed of a strip 2 to a machine 3 for the application of filter tips (not illustrated) to cigarettes (not illustrated).

The unit 1 has a line 4 for feeding the strip 2 to the machine 3 in a feed direction 5 along a path 6, the strip 2 being unwound from a reel 7 which has a central core 8, fitted on a shaft 9 which, when driven by a motor 10, rotates (clockwise in FIG. 1) about its own central axis which is transversal to the direction 5.

The unit 1 includes two cylindrical unwinding rollers 11 and 12, fitted in such a way that they rotate, clockwise in FIG. 1, about respective horizontal axes 11*a* and 12*a* which are parallel with one another and with the shaft 9; in particular, the roller 11 is power-driven, being coupled to a motor M.

The cylindrical surface of the roller 11 bears evenly distributed suction holes 13 which communicate, in a known way, with a suction source S through a fixed distributor 14 and a suction chamber 15 which extends in an arc 16, to hold the strip 2 against the cylindrical surface of the roller 11 along the arc 16.

As shown in FIG. 1, the rollers 11 and 12 are positioned along the path 6 downstream of a set of diverter rollers 17, one of which, denoted by reference number 18, is a known compensation roller connected to an actuator 19, and upstream of a gumming station 20, with a gumming unit 21 for the strip 2, and a subsequent station 22 for cutting the strip 2.

At the station 22, there is a drive and cutting unit 23 which includes a power-driven drum 24, which rotates, clockwise in FIG. 1, about its own axis, parallel with the axes 11*a* and 12*a*, and is designed to operate in a known way together with a roller 25 fitted with equidistant blades 26 for cutting the strip 2 into sections 27 which form the bands for connecting filter tips (not illustrated) and parts of cigarettes (not illustrated).

FIG. 1 also shows that, upstream of the gumming station 20, the path 6 extends through a curling station 28, where a flexing device 29 flexes the strip 2 transversally to the direction 5.

Figure 2:
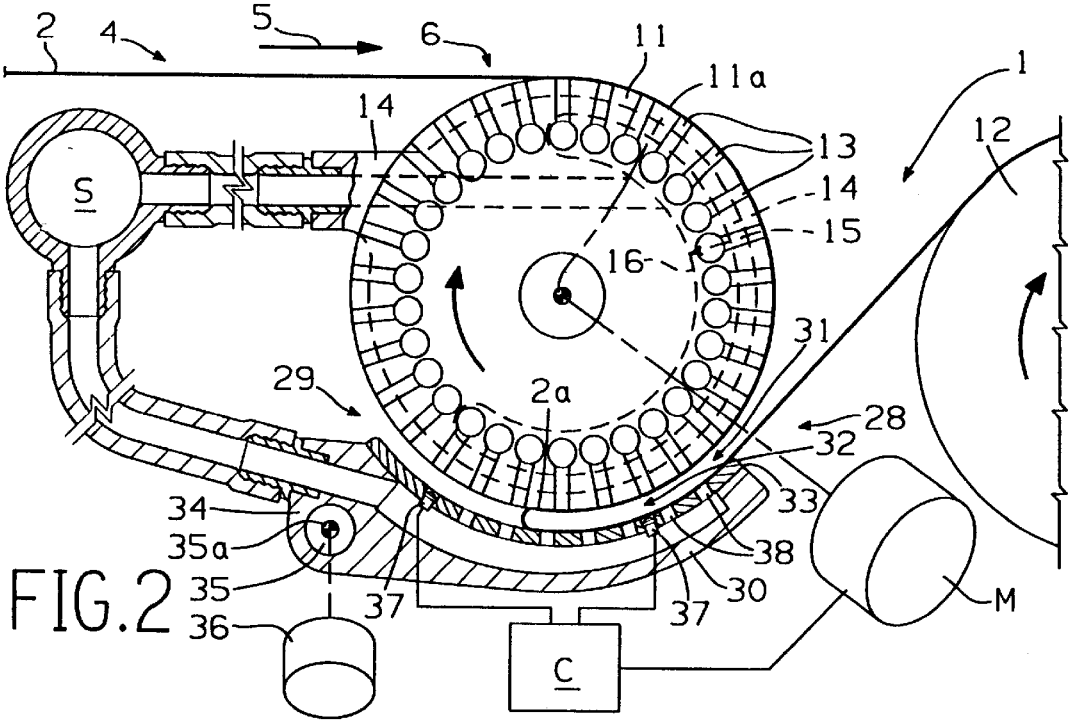
FIG. 2 is a scaled-up view of a variation on a detail from the unit in FIG. 1.

FIGS. 1 and 2 show that the flexing device 29 includes a guide 30 for the strip 2 which consists of a curved element 30, positioned opposite the unwinding roller 11, so that a chamber 31 is formed between the roller 11 and the curved element 30, a curved segment of the path 6 forming a loop 32 within the said chamber. It should be noticed that the roller 11 makes contact with a surface 2*a* of the strip 2 on the outside of the loop 32.

The curved element 30 has one free end 33 and one end 34 keyed to a pin 35 which, when driven by a motor 36 clockwise or anti-clockwise in FIGS. 1 and 2, rotates about its own axis 35*a* which is parallel with the axis 11*a* of the roller 11, allowing the curved element 30 to turn about the axis 35*a,* respectively moving towards or away from the cylindrical surface of the roller 11, to adjust the size of the loop 32.

The length or depth of the loop 32, measured from the end 33 of the curved element 30, may vary with the passage of time and is detected by a pair of optic sensors 37 fitted on the curved element 30 and designed to send a signal, in a known way, to a control unit C which is able to control the motor M of the roller 11, adjusting the speed of the roller 11, so that the length always remains within a given range.

In the embodiment illustrated in FIG. 2, the curved element 30 has holes 38 which communicate with the suction source S in such a way that the loop 32 is formed by the vacuum inside the chamber 31, the surface 2*a* of the strip 2 being held by suction against both the surface of the roller 11 and the surface of the curved element 30.

As the strip 2 is fed to the machine 3 along the path 6, the strip 2 passes through the station 28, where it is subjected to flexing, which reduces its rigidity by running it along the loop 32 between the surface of the roller 11 and the curved element 30.

The above description clearly indicates that the tension in the chamber 31 is constant, so that the tension transmitted to the strip 2 along the loop 32 is substantially constant, and the strip 2 is not subjected to sudden changes in load which cause breaks or tears.

Moreover, the movement of the curved element 30 away from or towards the roller 11 allows a respective increase or reduction in the size of the loop 32, allowing adjustment of the degree of curling according to the rigidity and/or thickness of the strip 2 used or the radius of curvature to be applied to the bands.

Moreover, the possibility of increasing the size of the loop 32 by simply turning the curved element 30, allows the correct feed of strip splicing zones towards the curling station 28, during the changeover from an old reel to a new reel, with easy, rapid operations and without tearing the strip 2.

Figure 3:
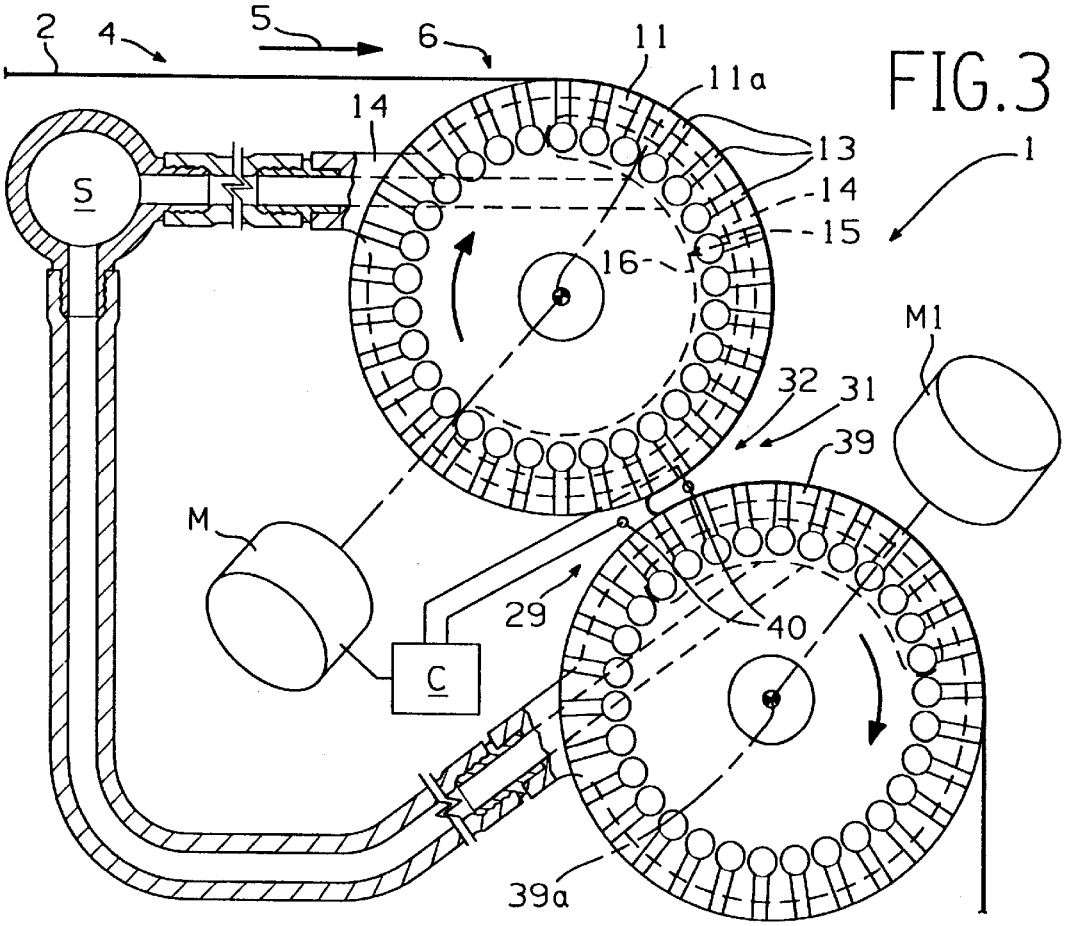
FIG. 3 is a schematic view, partly shown in cross-section and with some parts cut away to better illustrate others, of another embodiment of the unit disclosed.

In the embodiment illustrated in FIG. 3, the curved element 30 is replaced with a feed roller 39, which is connected to the source S and fitted so that it rotates about its own axis 39*a* which is parallel with the axis 11*a* so as to turn, clockwise in FIG. 3, about the axis 39*a* when driven by a motor M1. The roller 39 is positioned opposite the roller 11, so that the two define the chamber 31 inside which the loop 32 is formed by a vacuum. In this embodiment, the length of the loop 32 is detected by a pair of optic sensors 40 which are connected to the control unit C of the motor M, whilst the size of the loop 32 is adjusted by adjusting the distance between the axis 11*a* and the axis 39*a*.

What is claimed is:

1. Apparatus for continuously feeding a strip of flexible material to a machine, comprising:

a curling station;

drive means for feeding the strip along a path which extends through the curling station;

flexing means provided at said curling station for flexing the strip;

said path including a curved segment in which said strip feeds as a U-shaped loop, doubled back onto itself with spacing between two opposite branches of the loop;

said flexing means including two guide elements for the strip, respectively engaging outer sides of said two opposite branches of the loop;

said two guide elements being spaced apart so as to define a chamber for said loop;

one of said guide elements being a motor-driven unwinding roller having a curved outer periphery, and the other of said guide elements being an elongated element having a concave surface spacedly confronting said outer periphery of said unwinding roller; said elongated element being movably mounted for varying spacing between said outer periphery of said unwinding roller and said concave surface of said elongated element, for adjusting sizing of the loop;

an actuator for moving said elongated element for varying said spacing; and suction means for applying suction through both said outer periphery of said unwinding roller and through said concave surface of said elongated element, respectively to said outer sides of said two opposite branches of the loop.

2. The apparatus of claim 1, further including:

a loop length detection and control means;

said unwinding roller being motor driven by a variable speed drive; and;

said loop length detection and control means being effectively connected to said variable speed drive, for adjusting rotational speed of the unwinding roller in order to control the length of the loop.

3. Apparatus for continuously feeding a strip of flexible material to a machine, comprising:

a curling station;

drive means for feeding the strip along a path which extends through the curling station;

flexing means provided at said curling station for flexing the strip;

said path including a curved segment in which said strip feeds as a U-shaped loop, doubled back onto itself with spacing between two opposite branches of the loop;

said flexing means including two guide elements for the strip, respectively engaging outer sides of said two opposite branches of the loop;

said two guide elements being spaced apart so as to define a chamber for said loop;

one of said guide elements being a motor-driven unwinding roller having a curved outer periphery, and the other of said guide elements being a motor-driven feed roller having a curved outer periphery spacedly confronting said outer periphery of said unwinding roller; and suction means for applying suction through both the outer periphery of said unwinding roller and through said outer periphery of said feed roller, respectively to said outer sides of said two opposite branches of the loop.

4. The apparatus of claim 3, further including:

a loop length detection and control means;

said unwinding roller being motor driven by a variable speed drive; and;

said loop length detection and control means being effectively connected to said variable speed drive, for adjusting rotational speed of the unwinding roller in order to control the length of the loop.

5. A method for continuously feeding a strip of flexible material to a machine, comprising:

feeding the strip along a path which extends through a curling station, from a supply, to the machine;

at the curling station flexing the strip by feeding the strip between two curved guide elements which are spaced apart so as to define a chamber within which the two guide elements respectively engage outer sides of two opposite branches of a U-shaped loop of the strip;

engaging outer sides of two opposite branches of said loop by one of said guide elements being a motor-driven unwinding roller having a curved outer periphery, and the other of said guide elements being an elongated element having a concave surface spacedly confronting said outer periphery of said unwinding roller; said elongated element being movably mounted for varying spacing between said outer periphery of said unwinding roller and said concave surface of said elongated element, for adjusting sizing of the loop;

moving said elongated element for varying said spacing; and applying suction through both said outer periphery of said unwinding roller and through said concave surface of said elongated element, respectively to said outer sides of said two opposite branches of the loop.

6. The method of claim 5, further comprising:

detecting the length of said loop; and varying the speed of rotation of said unwinding roller in response to said detecting, for controlling the length of the loop.

7. A method for continuously feeding a strip of flexible material to a machine, comprising:

feeding the strip along a path which extends through a curling station, from a supply, to the machine;

at the curling station flexing the strip by feeding the strip between two curved guide elements which are spaced apart so as to define a chamber within which the two guide elements respectively engage outer sides of two opposite branches of a U-shaped loop of the strip;

engaging outer sides of two opposite branches of said loop by one of said guide elements being a motor-driven unwinding roller having a curved outer periphery, and the other of said guide elements being a motor-driven feed roller having a curved outer periphery spacedly confronting said outer periphery of said unwinding roller; and applying suction through both the outer periphery of said unwinding roller and through said outer periphery of said feed roller, respectively to said outer sides of said two opposite branches of the loop.

8. The method of claim 7, further comprising: detecting the length of said loop; and varying the speed of rotation of said unwinding roller in response to said detecting, for controlling the length of the loop.

9. Apparatus for continuously feeding a strip of flexible material to a machine, comprising:

a curling station;

drive means for feeding the strip along a path which extends through the curling station;

flexing means provided at said curling station for flexing the strip;

said path including a curved segment in which said strip feeds as a U-shaped loop, doubled back onto itself with spacing between two opposite branches of the loop;

said flexing means including two guide elements for the strip, respectively engaging outer sides of said two opposite branches of the loop;

said two guide elements being spaced apart so as to define a chamber for said loop;

one of said guide elements being a motor-driven unwinding roller having a curved outer periphery, and the other of said guide elements being an elongated element having a concave surface spacedly confronting said outer periphery of said unwinding roller; said elongated element being movably mounted for varying spacing between said outer periphery of said unwinding roller and said concave surface of said elongated element, for adjusting sizing of the loop;

an actuator for moving said elongated element for varying said spacing; and suction means for applying suction through said outer periphery of said unwinding roller to a respective outer side of a respective branch of the loop.

10. Apparatus for continuously feeding a strip of flexible material to a machine, comprising:

a curling station;

drive means for feeding the strip along a path which extends through the curling station;

flexing means provided at said curling station for flexing the strip;

said path including a curved segment in which said strip feeds as a U-shaped loop, doubled back onto itself with spacing between two opposite branches of the loop;

said flexing means including two guide elements for the strip, respectively engaging outer sides of said two opposite branches of the loop;

said two guide elements being spaced apart so as to define a chamber for said loop;

one of said guide elements being a motor-driven unwinding roller having a curved outer periphery, and the other of said guide elements being an elongated element having a concave surface spacedly confronting said outer periphery of said unwinding roller; said elongated element being movably mounted for varying spacing between said outer periphery of said unwinding roller and said concave surface of said elongated element, for adjusting sizing of the loop;

an actuator for moving said elongated element for varying said spacing; and suction means for applying suction through said concavely curved surface of said elongated element to a respective outer side of a respective branch of said loop.

* * * * *